US006371696B1

(12) United States Patent
Eathorne

(10) Patent No.: US 6,371,696 B1
(45) Date of Patent: Apr. 16, 2002

(54) PYLON SERVICING APPARATUS

(76) Inventor: Russell James Eathorne, 42 McCoy Street, Myaree, WA 6154 (AU)

( * ) Notice: Subject to any disclaimer, the term of this patent is extended or adjusted under 35 U.S.C. 154(b) by 0 days.

(21) Appl. No.: 09/485,997

(22) PCT Filed: Aug. 21, 1997

(86) PCT No.: PCT/AU98/00675

§ 371 Date: Feb. 18, 2000

§ 102(e) Date: Feb. 18, 2000

(87) PCT Pub. No.: WO99/10232

PCT Pub. Date: Mar. 4, 1999

(30) Foreign Application Priority Data

Aug. 21, 1997 (AU) ..... PO8714

(51) Int. Cl.[7] ..... E02D 5/60

(52) U.S. Cl. ..... 405/211; 405/211.1; 405/216

(58) Field of Search ..... 405/211, 211.1, 405/216; 52/169.9, 741.3

(56) References Cited

U.S. PATENT DOCUMENTS

| | | | | | |
|---|---|---|---|---|---|
| 1,411,404 | A | * | 4/1922 | Camp | 405/216 |
| 1,436,978 | A | * | 11/1922 | Camp | 405/216 X |
| 4,102,144 | A | * | 7/1978 | Anders | 405/211 |
| 4,720,213 | A | * | 1/1988 | Gernhardt et al. | 405/190 |
| 5,226,751 | A | * | 7/1993 | Doleshal | 405/211.1 |

FOREIGN PATENT DOCUMENTS

| | | | | |
|---|---|---|---|---|
| AU | 36817/84 A | | 6/1985 | |
| GB | 2114636 A | | 8/1983 | |
| JP | 3187405 | * | 8/1981 | 405/216 X |
| JP | 59170315 | * | 9/1984 | 405/211 X |
| JP | 6278324 | * | 4/1987 | 405/216 X |
| WO | WO 87/02640 A1 | | 5/1987 | |
| WO | WO 92/18379 A1 | | 10/1992 | |

* cited by examiner

*Primary Examiner*—David Bagnell
*Assistant Examiner*—Sunil Singh
(74) *Attorney, Agent, or Firm*—Merchant & Gould P.C.

(57) ABSTRACT

A pylon servicing apparatus comprising a carriage (11) having a first drive mechanism (17) provided on the carriage (11), the first drive mechanism (17) being adapted to engage the pylon (10) to enable the carriage (11) to be moved longitudinally along the pylon (10), the carriage (11) supporting a housing defining a space, the housing having two opposed end walls and at least one side wall extending between the end faces, the end faces having inner edges (30) being configured to be receivable about the pylon (10), the housing being divided axially into at least two portions (13) which are pivotally interconnected to be movable between a closed position defining the space and an open position, a second drive mechanism (16) provided between the portions (13) to enable the movement between the open, and closed position, wherein when the portions (13) are in the closed position they can cooperate with the pylon (10) to form an annular space surrounding the portion of the length of the pylon located between the end faces and when in the open position the housing can be moved into and out of engagement with the pylon (10), a first sealing mechanism (32) provided on the inner edge of each end wall and adapted to be sealingly engageable with the pylon (10) when the portions (13) are in the closed position and a second sealing mechanism (27) provided on the abutting edges of each portion (13). The second sealing mechanism on one portion is adapted to be sealingly engageable with the second sealing mechanism (27) on the adjacent portion when the portions (13) are in the closed position.

25 Claims, 9 Drawing Sheets

PYLON SERVICING APPARATUS

FIELD OF THE INVENTION

Throughout the specification the term "pylon" shall be taken as comprising an elongate element which may be disposed at any angle with respect to the horizontal axis and which may be located in a terrestrial, aquatic or marine environment. The term shall also be taken to include struts and interconnecting members which may be provided between columns and the like for support.

BACKGROUND OF THE INVENTION

The present invention comprises a development of the underwater servicing device which is the subject of PCT/AU92/00160 which has application to the servicing and treatment of surfaces such as ships hulls dam walls and the like, but is limited in its application in regard to the surfaces of pylons because of the degree of curvature of those surfaces. In the past the underwater surfaces of pylons have been inspected and serviced by divers which is hazardous and very labour intensive and presents significant difficulties in regard to deep water installations.

DISCLOSURE OF THE INVENTION

It is an object of the present invention to provide a pylon servicing apparatus which is capable of traversing the length of a pylon to enable the suite of the pylon to be treated. In addition the apparatus of the invention need not be restricted to use in an underwater environment Accordingly the invention resides in a pylon servicing means comprising a carriage having a first drive means provided on the carriage, said first drive means being adapted to engage the pylon to enable the carriage to be moved longitudinally along the pylon, the carriage supporting a housing which can be received around a pylon, the housing defining a space, said housing having two opposed end walls and at least one side wall extending between the end walls, the end walls having inner edges being configured to be receivable about the pylon, said housing being divided axially into at least two portions which are pivotally interconnected to be movable between a closed position defining said space and an open position, a second drive means provided between the portions to enable the movement between the open and closed position, wherein when the portions are in the closed position they can cooperate with the pylon to form an annular space surrounding the portion of the length of the pylon located between the end faces and when in the open position the housing can be moved into and out of engagement with the pylon, a first sealing means provided on the inner edge of each end wall and adapted to be sealingly engageable with the pylon when the portions are in the closed position and a second sealing means provided on at least one of the abutting edges of each portion and adapted to be sealingly engageable with the adjacent portion when the portions are in the closed position.

According to a preferred feature of the invention the first sealing means are selectively movable into and out of sealing engagement with the pylon when the portions are in the closed position.

According to a further preferred feature of the invention the pylon servicing means is capable of being used with a pylon where a portion of the pylon is underwater. According to further preferred feature the pylon servicing means further comprises an evacuation means adapted to pump water-from the annular space, a valve means adapted to be controllable to permit the entry of water into the annular space and a ventilation means adapted to permit the entry of air into the space.

According to a preferred feature of the invention the space accommodates a servicing means adapted to treat the surface of the pylon accommodated by the annular space. According to a further preferred feature the servicing means is provided with a surveying means which is capable of enabling the surface of the pylon to be surveyed remotely. According to a particular embodiment the surveying means comprises a remotely controlled camera and/or a non-destructive testing means.

According to a further preferred feature of the invention the servicing means comprises a head member which is capable of moving circumferentially around the annular space and longitudinally through the annular space. According to a further preferred feature, a control means adapted to cause said circular and longitudinal movement of the head member in a controlled manner. According to one embodiment of the invention the head member is capable of directing a high pressure fluid blast onto the surface of the pylon. The fluid blast may include abrasive particulate materials entrained in the fluid flow. It is a further feature of the embodiment that the head member is capable of applying a coating to the surface of the pylon. According to various forms of the embodiment of the invention the coating can comprise a sealant, a paint composition, a grouting composition, concrete or any combination of such. It is a further feature of the embodiment that the head member is capable of directing a ted gaseous flow onto the surface of the pylon. It is a further feature of the embodiment that the servicing head includes the means of remotely inspecting and surveying the surface which means may comprise a camera and/or a non-destructive testing means.

According to a further preferred feature of the invention said first drive means comprises a set of driven wheels supported from the carriage which are moveable radially into and out of engagement with the pylon. According to one embodiment of the invention when the driven wheels are out of engagement with the pylon and the portions are in the open position the carriage can be moved radially into and out of engagement with the pylon and longitudinally along the pylon and when the driven wheels are in engagement with the pylon the carriage is only capable of longitudinal movement along a pylon. It is preferable that the second drive means is operable independently of the first drive means. It is a further preferred feature of the embodiment that the driven wheels are not able to cause longitudinal movement of the carriage on the pylon when the first sealing means is in engagement with the pylon.

According to the further preferred feature of the invention the carriage is provided with a thruster means adapted to be capable of being activated to cause movement through water, said thruster applying a force to the carriage which can be transverse and/or parallel to the central axis of the housing.

According to a further preferred feature of the invention the carriage is associated with a ballast means which is associated with a means for delivering water and air into the ballast means to vary the buoyancy of the apparatus between positive, neutral and negative buoyancy.

According to a further preferred feature of the invention the housing has a generally cylindrical shape when the portions are in the closed position.

The invention will be more fully understood in the light of the following description of several specific embodiments.

BRIEF DESCRIPTION OF THE DRAWINGS

The description is made with reference to the accompany drawings of which.

BEST MODES FOR CARRYING OUT THE INVENTION

Each of the embodiments of the invention are directed towards a pylon servicing apparatus which is capable of cleaning the surfaces of a pylon. The embodiments are particularly directed towards a servicing apparatus which is capable of cleaning the underwater services of pylons but which is also capable of servicing surfaces of pylons in terrestrial environments or above the water line.

Figure 1:
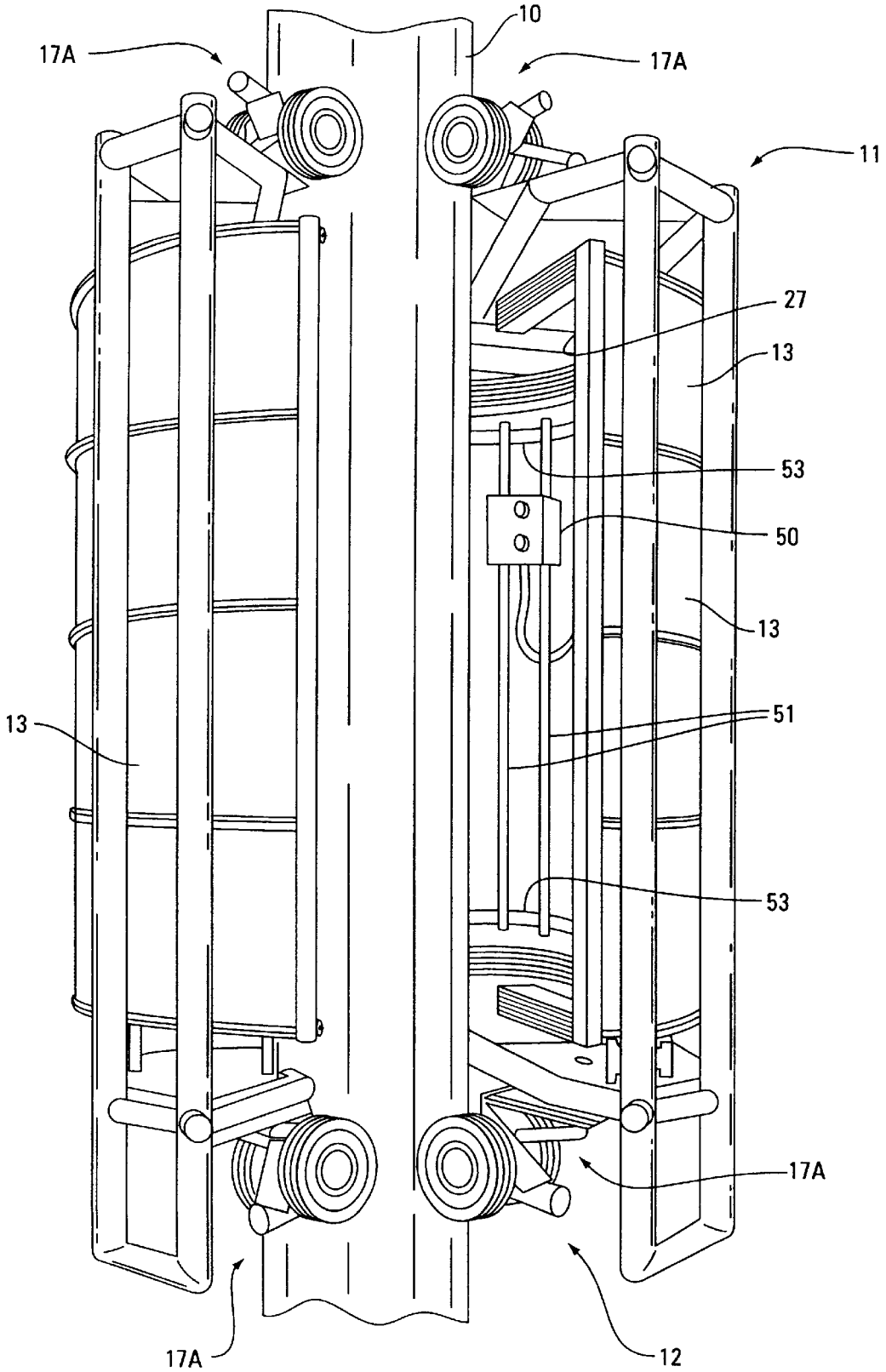
FIG. 1 is a schematic isometric view of the first embodiment supported upon a pylon with the portions in the open position.
Figure 2:
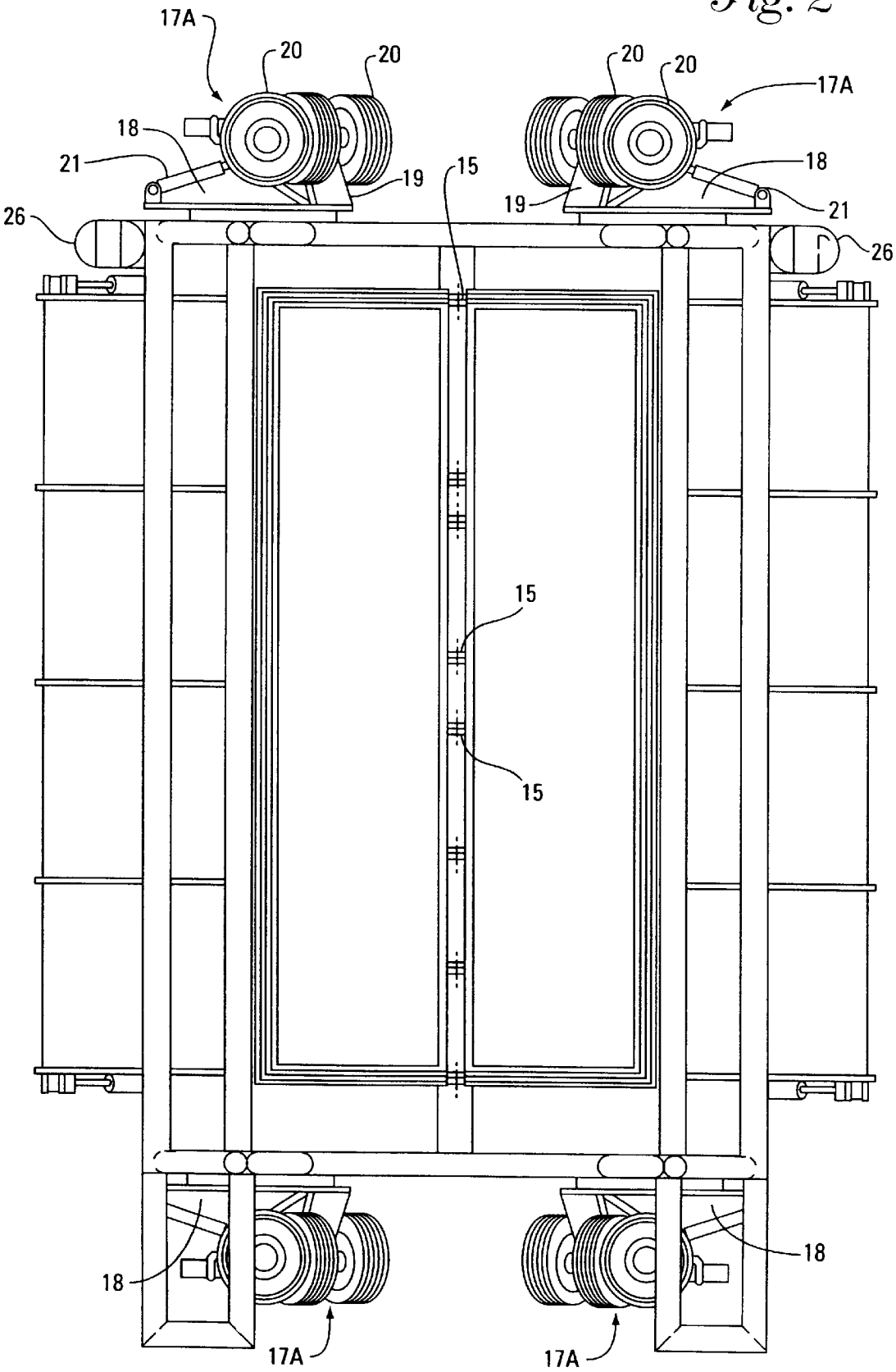
FIG. 2 is a side elevation of the first embodiment with the portions in to open position and the driven wheels in the retracted position.
Figure 3:
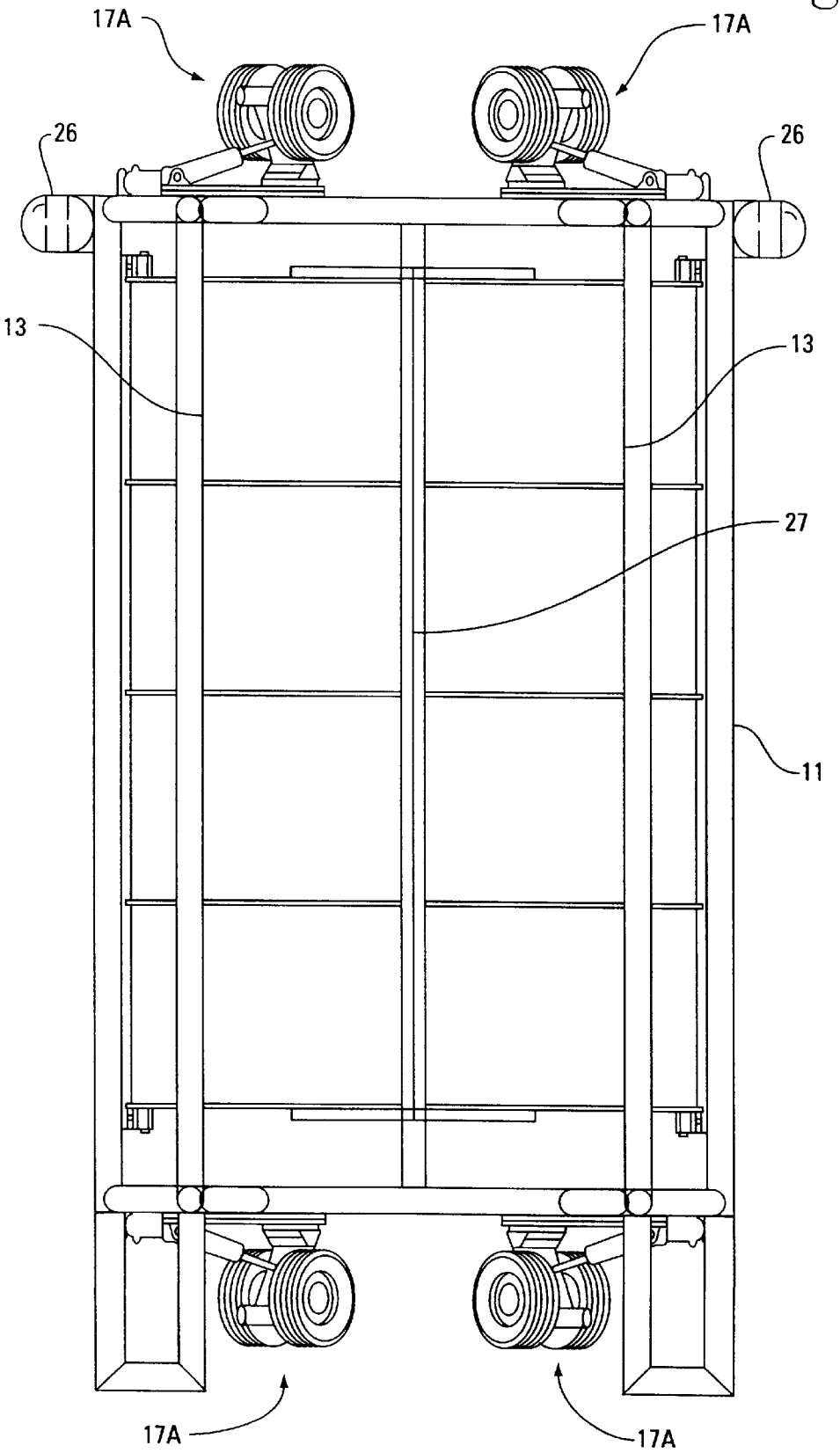
FIG. 3 is a side elevation of the first embodiment with the portions in the closed position and the driven wheels in the engaged position.
Figure 4:
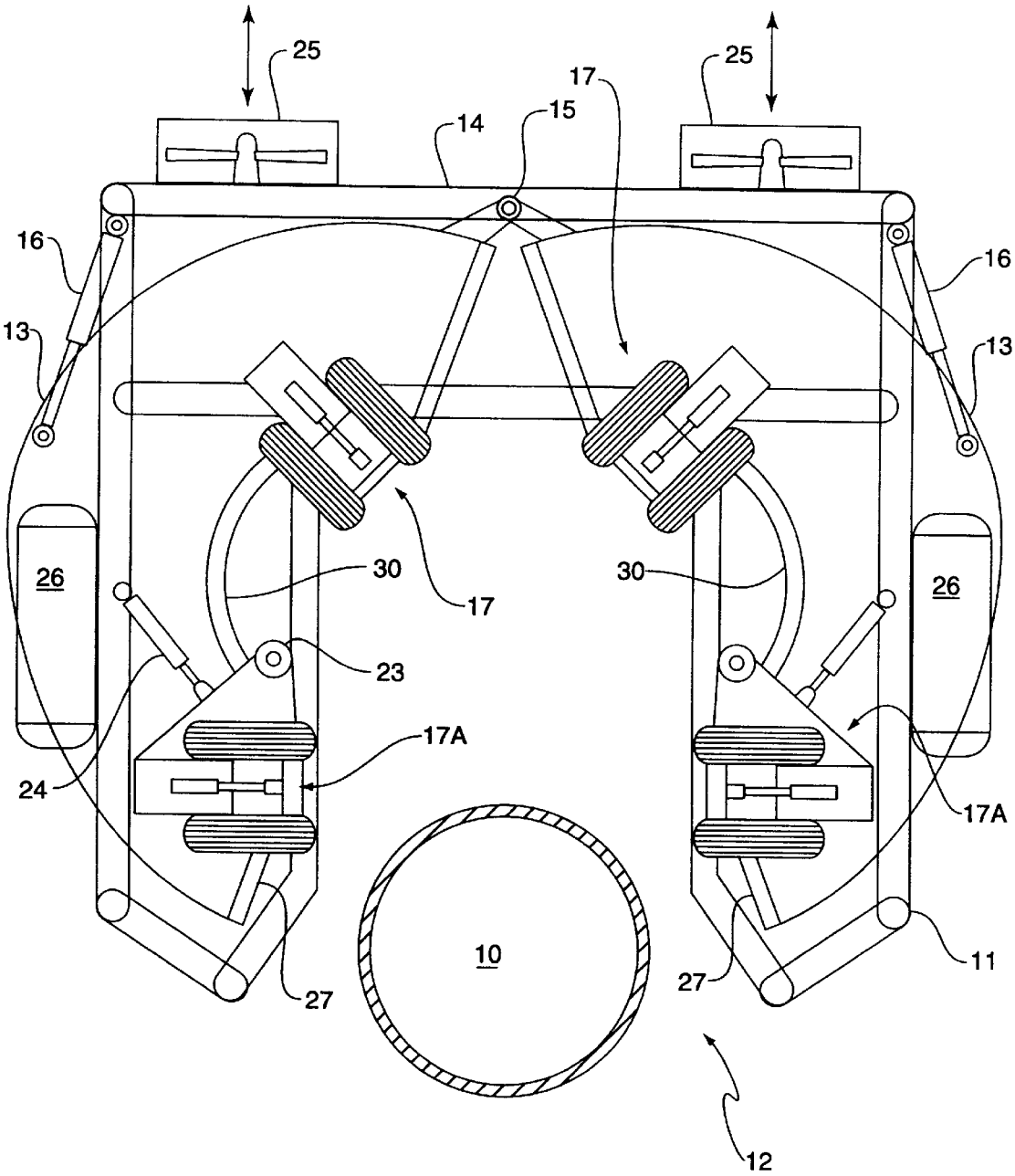
FIG. 4 is a plan view of the first embodiment with the portions in the open position and the driven wheel: in the retracted position.
Figure 5:
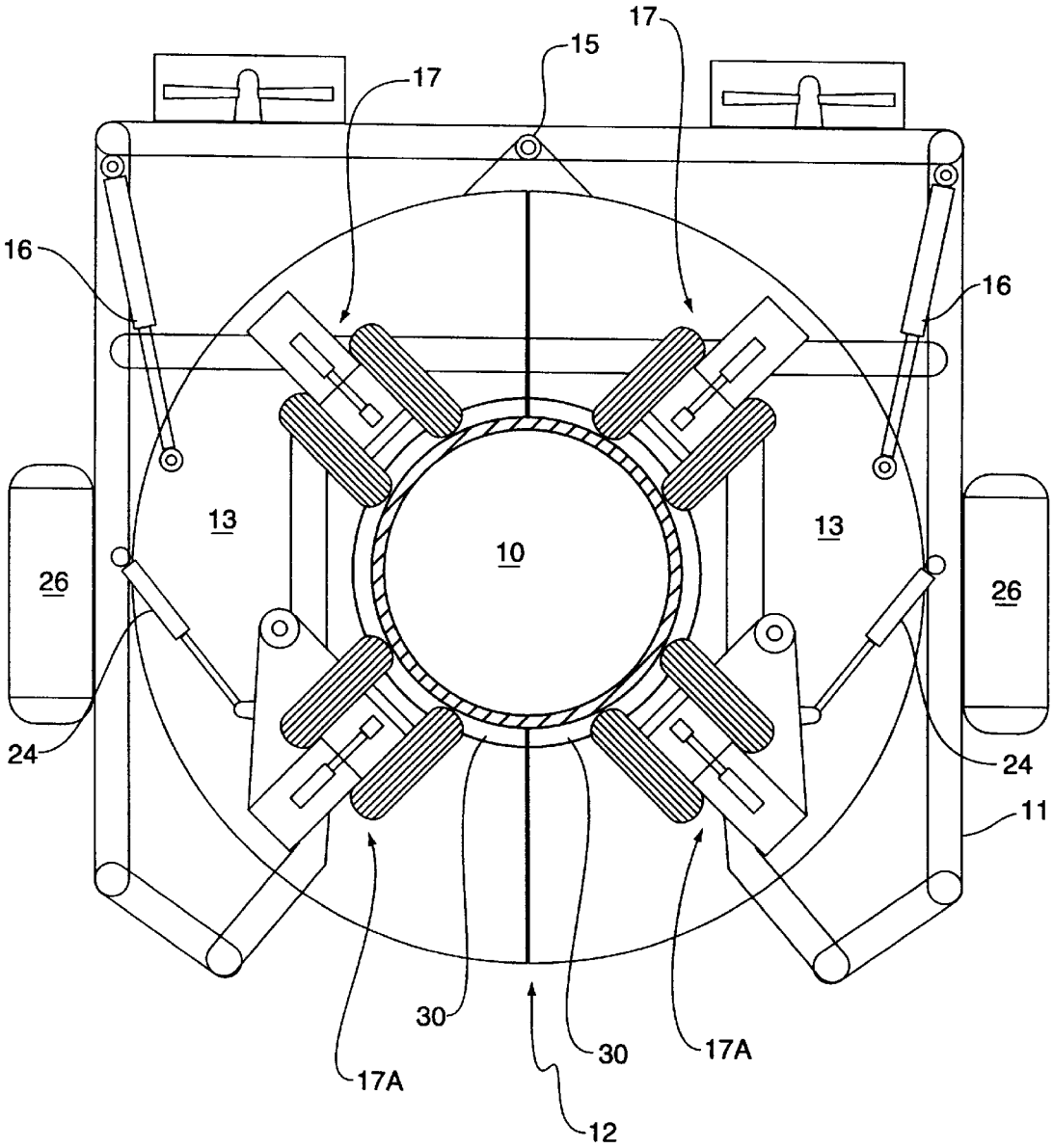
FIG. 5 is a plan view of the first embodiment with the portions in the closed position and the driven wheels in the engaged position around a pylon.

The first embodiment as shown at FIGS. 1, 2, 3, 4, 5 and 6 comprises a carriage 11 which is formed by a frame of a generally cubic configuration having one side 12 which is open. The carriage supports two housing portions 13 which are generally semicircular in cross-section and are hingedly supported from the rear face 14 of the carriage from a plurality of axially spaced hinge 15 whereby the portions 13 are capable of being moved into a closed position as shown at FIGS. 3 and 5 at which they define an annular space which encloses a central space which can be accommodated by a pylon 10 and an open position as shown at FIGS. 1, 2 and 4 at which the portions 13 are extended way from each other to provide free access of a pylon 10 through the open face 12 of the carriage 11 as shown at FIG. 4. A second drive means 16 in the form of a plurality of fluid operated extendible rams 16 (which may be pneumatically or hydraulically operated) are provided between the carriage 11 and ash of the portions 13 to facilitate movement of the portions 13 batten the noted position and the open position. The pivotal engagement which is provided between the portions 13 by virtue of the hinged connections 15 is such that any abrasive engagement of the seals 27 provided on the abutting radial faces of the portions and the abutting axial faces of the portions is minimised and that any abrasive contact between the seals and the surface of the pylons are also minimised. This is effected by displacing the pivot axis of the hinges 15 radially outwardly from the outer face of the portions 13.

In addition each end of the carriage 11 is provided with a first drive means which each comprise a set of four driven wheel assemblies 17. Each driven wheel assembly 17 comprises a base 18 mounted to the respective and of the carriage and a pivot arm 19 pivotally supported from the base 18 for rotation about a transverse axis of the carriage. The outer end of the pivot am 19 supports a pair of wheels 20 which are driven from a drive motor which can take the form of an electrically or fluid driven (eg hydraulic or pneumatic) drive motor. Each pivot arm is controlled in it's movement by a second fluid operated cylinder 21 whereby the wheels 20 are moveable radially with respect of the central axis of the apparatus between an engaged position as shown at FIGS. 3 and 5 at which they are in engagement with the surface of the pylon 10 and a retracted position as shown at FIGS. 2 and 4 at which they are clear from the surface of the pylon. In addition the drive wheel assemblies 17*a* which are most adjacent the front face of the carriage are pivotally supported from the carriage about a second pivot axis 23 which is parallel to the central axis of the carriage and which is controlled in its movement by a third fluid operated cylinder 24 whereby the forward driven wheel assemblies 17*a* can be displaced angularly with respect to the central axis of the carriage between the position clear of the open face 12 of the frame as shown at FIGS. 2 and 4 in the position extending across the open face 12 as shown at FIGS. 1, 3 and 5.

In addition the rear face 14 of the carriage supports a pair of thruster elements 25 which incorporate propellers which are capable of being controlled to apply a thrust, which can be transverse and/or parallel to the central longitudinal axis of the carriage, to the carriage when submerged in water.

The carriage is further provided with a buoyancy means which serves to balance the apparatus such that it is stable when the central axis of the carriage is substantially upright and which provides a variable ballast means for the carriage to vary its degree of buoyancy. The variable ballast means comprises tanks 26 which are placed at spaced intervals on the carriage and which are associated with a means for delivering water or air into the ballast means in order to vary the buoyancy of the apparatus between a negative buoyancy, a neutral buoyancy, and a positive buoyancy. By control of the ballast means in association with the thruster means 25 it is possible for the apparatus to be able to be moved through the water into and out of engagement with the pylon. In addition, the ballast means can be used to assist in the movement of the submerged apparatus along the pylon.

The edges of the portions 13 which will abut when the portions 13 are closed are provided with suitable seals 27 such that when the potions are in the closed position the seals 27 will positively interengage to prevent water flow between the abutting edges. In addition each end of the portions 13 are provided with a part annular seal ring 30 which is associated with a sealing member 32 whereby the sealing member 32 can be activated to be brought into an out of sealing engagement with the surface of the pylon at each end of the portions 13. On activation of the sealing member such that it is in sealing engagement with the surface of the pylon the annular space defined between the pylon and the interior of the portions becomes a sealed, isolated space.

The base of the portions 13 are provided with a drainage sump 70 and a pump means 71 connected to the drainage sump whereby when the portions 13 are in their closed position and in sealing engagement with the pylon, water and waste can be pumped from the annular space 72 so defined. In order to facilitate such a suitable vent means 73 which extends above the surface of the water is provided to allow air to enter the annular space. A valve means 74 is controllable to permit entry of water into the annular space 72.

In use it is intended that for the apparatus according to the first embodiment to be applied to a pylon it is lowered into the water and the ballast means is adjusted to enable the apparatus to sink or remain partially submerged. When the apparatus is at the appropriate position along the pylon the ballast means can be adjusted such that the buoyancy is substantially neutral and with the portions 13 in the open position a shown at FIG. 2 and application of t trusters 25, the apparatus can be moved through the water to be applied to a pylon as illustrated at FIG 4. Once the pylon has been received into the carriage the driven wheel assembly 17 is activated such that the driven wheels 20 are moved into engagement with the surface of the pylon to support the carriage from the pylon. The portions 13 are then caused to be moved to the closed position such that they abut with each other and are in close surrounding engagement with the pylon 10. On activation of the drive motors the carriage can be moved along the pylon to the desired position. When in position the seal on each of the sealing rings 30 is then activated to bring the sealing member 32 at each end face of the portions into engagement with the surface of the pylon and to sealingly isolate the annular space defined by the portions 13 and the surface of the pylon 10 included in that space from the ambient water. Once the seals have been so engaged the water is pumped from the annular space and air is allowed to flow into that space to fill the annular space. At this point in time the ballast means may be activated such that the buoyancy provided by the air within the annular space is counteracted by the ballast means. Once the annular space has been evacuated of water the servicing of the surface of the pylon can take place.

Once that surface has been serviced the apparatus can then be moved along the length of the pylon. This is effected by flooding the annular space defined by the portions, deactivating the sealing members 32 and activating the drive motors driving each of the driven wheels 21 in order that the apparatus can be moved along the pylon 10 to the next position on the pylon. To aid in this movement the ballast means may be varied in its buoyancy to assist in the movement of the carriage along the pylon.

On completion of the servicing of the pylon, the driven wheel assemblies 17 are retracted from engagement of the pylon and the forward driven wheel assemblies 17*a* are retracted clear of the open face 12 of the carriage such that the carriage is then able to be moved from engagement with the pylon by activation of the ballast means and the thrusters 25.

Figure 6:
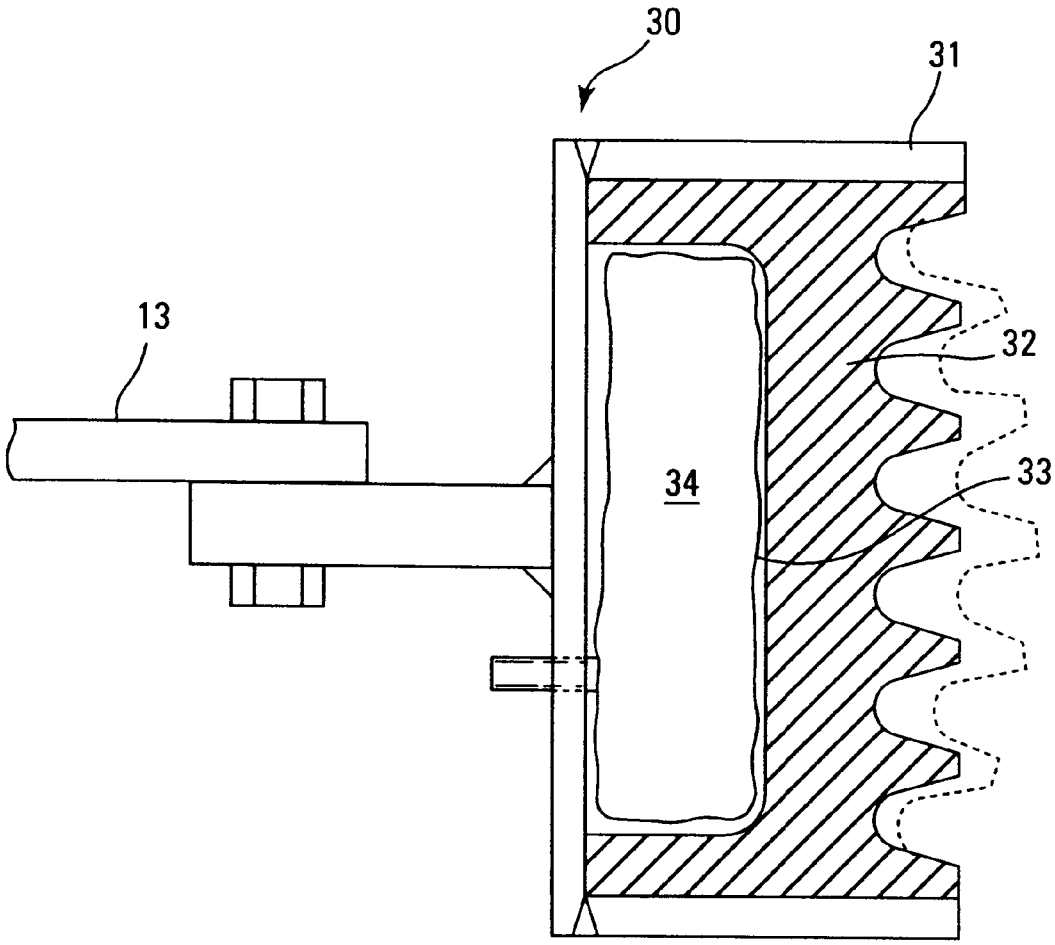
FIG. 6 is a schematic sectional elevation of a sealing means according to the first embodiment.

The sealing means of the embodiment is shown schematically at FIG. 6 and comprises a semi-circular member 30 which is mounted to the inner edge of the end wall of the portion 13 whereby the innermost edge of the semicircular member 30 is formed as a channel 31 which accommodates a flexible resilient seal member 32. The seal member 32 extends across the open face of the channel 31 and is bonded at either end to the flanges of the channel 31. The outermost face of the seal has a ribbed configuration to enhance sealing engagement with the surface of the pylon. The interior of the seal 32 is provided with a plenum space 33 which is associated with a bladder 34. The bladder 34 is connected to a source of pressurised fluid or gas which will cause inflation of the bladder 34 and resilient displacement of the outer face of the seal such that it will become engaged with the surface of the pylon as shown at broken lines at FIG. 6. It is intended that the annular ring 30 is capable of being replaced by annular rings of varying widths to enable the apparatus to be used with pylons of varying diameters.

To service the surface of the pylons the portions 13 accommodate a servicing apparatus which can be observed in FIG. 1. The servicing apparatus comprises a mobile head 50 which is slidably received upon a pair of parallel axial rails 51 to be capable of longitudinal movement through the annular space. The axial rails 51 are in turn supported at each end from a circumferential rail 53 provided at each end of the portion 13 whereby the rails 51 are capable of movement around the circular rails 53 when the portions 13 are interengaged together. As a result of the movement of the head 50 on the axial rails 51 and on the circular rails 53 the mobile head is capable of traversing the surface of the pylon which is encompassed by the closed portions 13. The mobile head 50 is associated with nozzles connected to a high pressure fluid source whereby high pressure fluid can be blasted onto the surface of the pylon for cleaning. The mobile head is further associated with spray nozzles which are connected to a source of coating composition whereby the surface of the pylon can be coated with a suitable coating composition. The mobile head is further provided with gaseous jets which are connected to a source of heated gaseous flow whereby a heated gaseous flow can be directed onto the surface of the coated pylon to effect drying of the coating. As a result with sequential movement of the mobile head 50 over the surface of the pylon that surface can be cleaned, coated and then dried. In addition the sump provided in the portions 13 is connected to a drain means which is capable of delivering debris and waste liquors which result from the cleaning and coating process to a suitable storage receptacle which may be provided on the surface.

Figure 7:
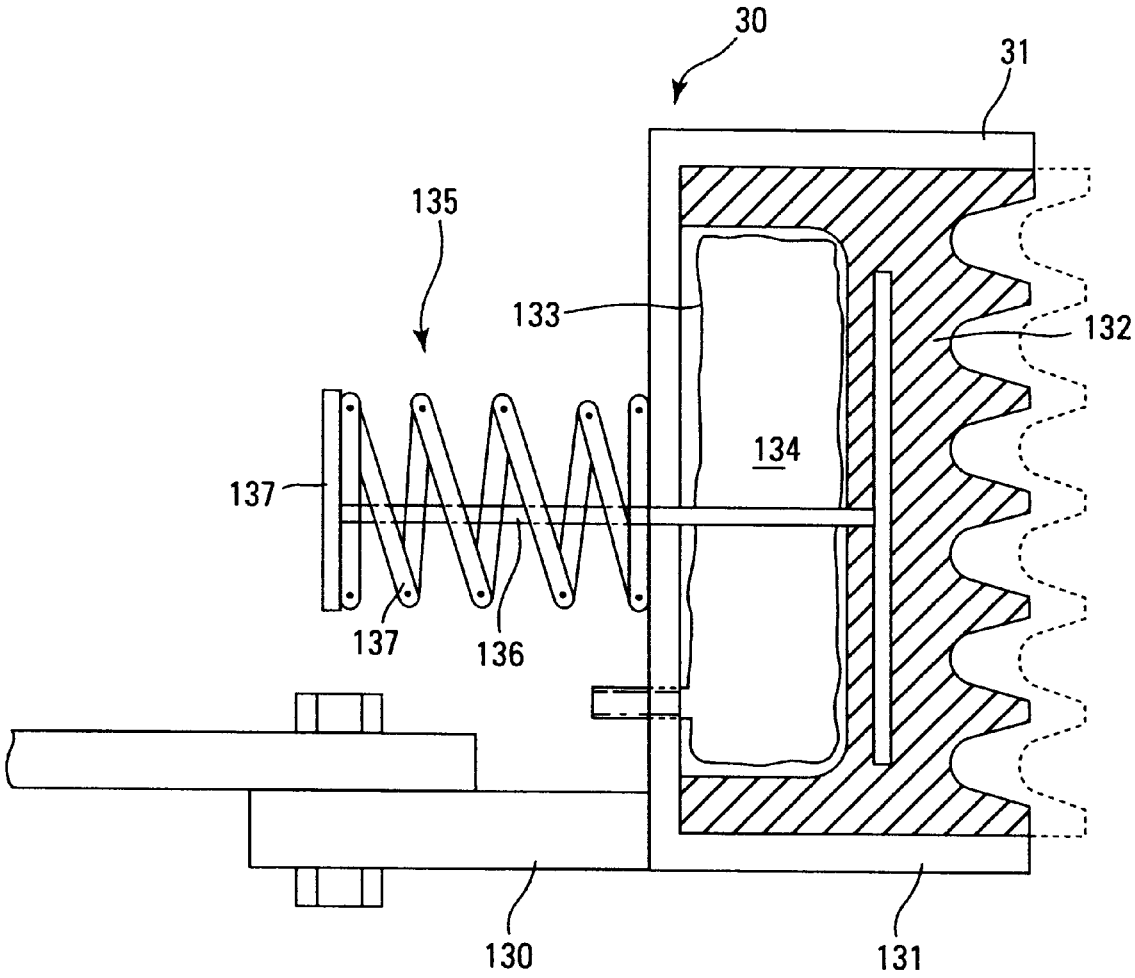
FIG. 7 is a sealing means according to a second embodiment of the invention.
Figure 8:
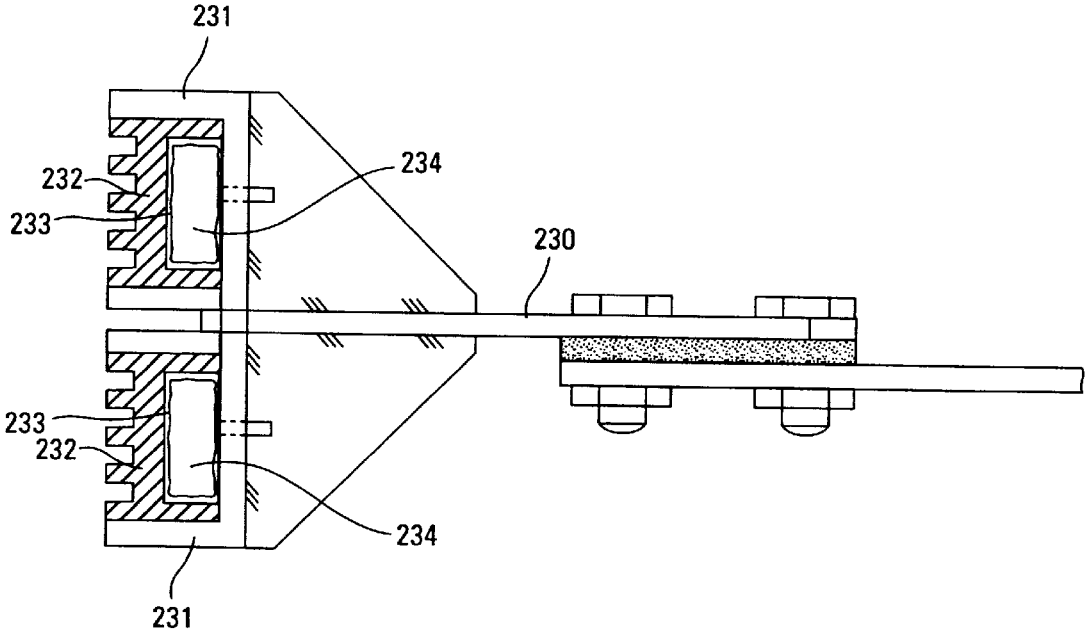
FIG. 8 is a sectional elevation of a sealing means according to a third embodiment of the invention.
Figure 9:
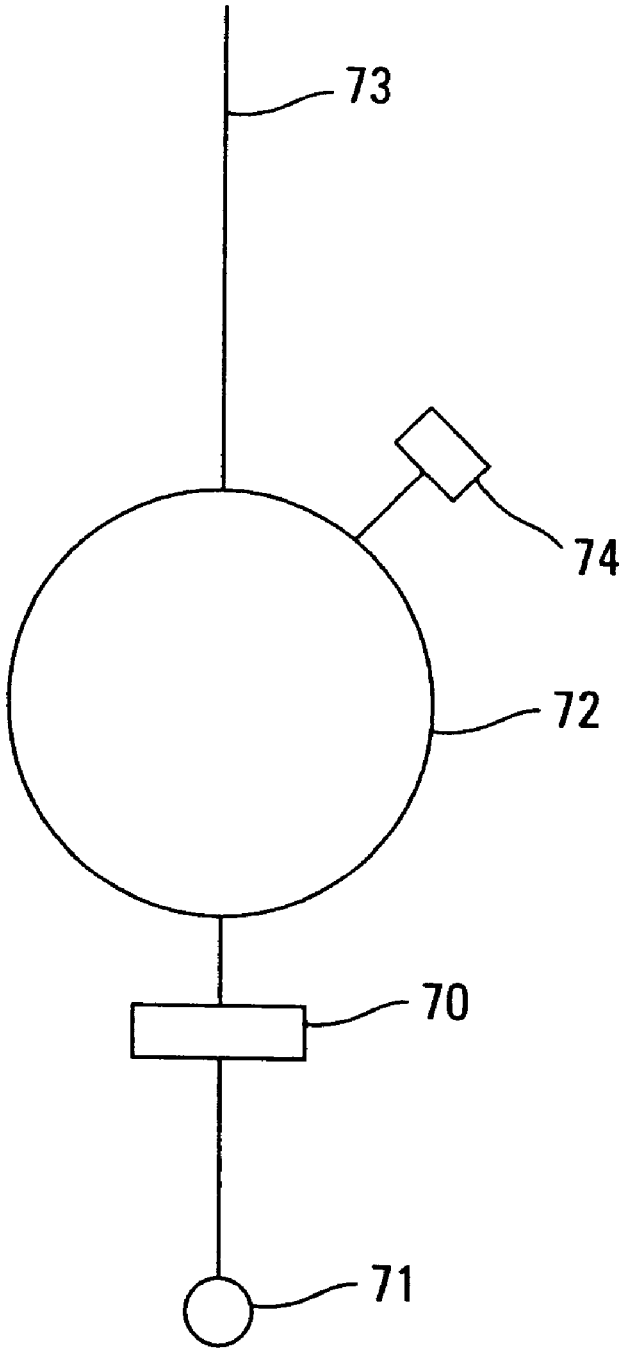
FIG. 9 is a schematic illustration of the drainage sump, pump means, vent means, and valve means for evacuating and filling the annular space.

In addition the mobile head 50 supports a remotely controlled camera which enables the surface to be inspected prior to, during and subsequent to treatment As an alternative to the camera or in addition to the camera the mobile head may be provided with a sensing means which is able to perform non-destructive testing of the surface before, during and after the cleaning and coating procedures to monitor the quality of the surface, the adequacy of the cleaning action and the adequacy of the coating action FIG. 7 illustrates a second embodiment which varies from the first embodiment by the nature of the sealing member. In the case of the second embodiment as shown at FIG. 7, the sealing ring 130 is of substantially the same form as the first embodiment. The essential difference between the first and the second embodiments relates to the nature of the seal 132. In the case of the second embodiment the seal 132 is slidably received within the channel 131 whereby on inflation of the bladder 134 the seal 132 is moved bodily outwardly with respect to the channel 131. The seal is associated with a biasing means 135 which is capable of retaining the seal 132 in its retracted position. The biasing means 135 comprises a central rod or of the like extending from the interior of the seal 132 and outwardly from the rear face of the channel 131 whereby the outer end of the rod 136 is provided with an abutment. A compression spring 138 is provided between the rear face of the channel 131 and the abutment 137 to bias the seal 132 into its retracted position.

The third embodiment comprises a variation of the second embodiment wherein a pair of seals are provided in parallel relationship to enhance the sealing engagement with the surface of the pylon.

Each of the embodiments provide a means which is capable of servicing pylons in both a terrestrial and aquatic or marine environment whereby the whole length of the pylon can be serviced. Such servicing is effected in stages whereby the movement of the apparatus from one stage to another can only be effected on sealing disengagement between the seals and the pylon.

It is envisaged that the apparatus of the above embodiments can be used by being suspended from above the pylon or a structure associated with the pylon or a vessel on the water adjacent the pylon for engagement with the pylon. Alternatively the embodiment can operate as an independent vehicle which can be remotely controlled from the surface.

It should be appreciated that the scope of the present invention need not be limited to the particular scope of the embodiments described above.

The amended claims defining the invention are as follows:

1. A pylon servicing means comprising:

a carriage having a first drive means provided on the carriage, said first drive means being adapted to engage the pylon to enable the carriage to be moved longitudinally along the pylon;

a housing supported on said carriage, the housing adapted to be receivable around the pylon, said housing having two opposed end walls and at least one side wall extending between the end walls, the end walls having inner edges being configured to be receivable about the pylon, and said housing being divided axially into at least two portions which are pivotally interconnected to be movable between a closed position and an open position;

a second drive means connected to the portions to enable the movement between the open and closed position;

a first sealing means provided on the inner edge of each end wall and adapted to be sealingly engageable with the pylon when the portions are in the closed position around the pylon; and a second sealing means provided on abutting edges of each portion, said second sealing means adapted to be sealingly engageable with each other when the portions are in the closed position;

wherein when the portions are in the closed position around the pylon an annular space is defined between the outer surface of the pylon and the housing, and when the portions are in the open position the housing can be moved into and out of position relative to the pylon.

2. A pylon servicing means as claimed in claim 1 wherein the first sealing means are selectively movable into and out of sealing engagement with the pylon when the portions are in the closed position.

3. A pylon servicing means as claimed in claim 1 wherein said pylon servicing means is capable of being used with a pylon where a portion of the pylon is underwater.

4. A pylon servicing means as claimed in claim 3 wherein said pylon servicing means further comprises an evacuation means adapted to pump water from the annular space, a valve means adapted to be controllable to permit the entry of water into the annular space and a ventilation means adapted to permit the entry of air into the annular space.

5. A pylon servicing means as claimed in claim 1 wherein the space accommodates a servicing means adapted to treat the surface of the pylon accommodated by the annular space.

6. A pylon servicing means as claimed in claim 5 wherein the servicing means is provided with a surveying means which is capable of enabling the surface of the pylon to be surveyed remotely.

7. A pylon servicing means as claimed in claim 6 wherein the surveying means includes a remotely controlled camera.

8. A pylon servicing means as claimed in claim 6 wherein the surveying means includes a non-destructive testing means.

9. A pylon servicing means as claimed in claim 5 wherein the servicing means comprises a head member which is capable of moving circumferentially around the annular space and longitudinally through the annular space.

10. A pylon servicing means as claimed in claim 9 further comprising a control means adapted to cause said circular and longitudinal movement of the head member in a controlled manner.

11. A pylon servicing means as claimed in claim 9 wherein the head member is capable of directing a high pressure fluid blast onto the surface of the pylon.

12. A pylon servicing means as claimed in claim 11 wherein the fluid blast may include abrasive particulate materials entrained in the fluid flow.

13. A pylon servicing means as claimed in claim 9 wherein the head member is capable of applying a coating to the surface of the pylon.

14. A pylon servicing means as claimed in claim 13 wherein the coating can comprise a sealant, a paint composition, a grouting composition, concrete or any combination of such.

15. A pylon servicing means as claimed in claim 9 wherein the head member is capable of directing a heated gaseous flow onto the surface of the pylon.

16. A pylon servicing means as claimed in claim 9, wherein the servicing means is provided with a surveying means which is capable of enabling the surface of the pylon to be surveyed remotely, and wherein the head member includes the surveying means.

17. A pylon servicing means as claimed in claim 1 wherein said first drive means comprises a set of driven wheels supported from the carriage which are moveable radially into and out of engagement with the pylon.

18. A pylon servicing means as claimed in claim 17 wherein when the driven wheels are out of engagement with the pylon and the portions are in the open position the carriage can be moved radially into and out of engagement with the pylon and longitudinally along the pylon and when the driven wheels are in engagement with the pylon the carriage is only capable of longitudinal movement along a pylon.

19. A pylon servicing means as claimed in claim 17 wherein the second drive means is operable independently of the first drive means.

20. A pylon servicing means as claimed in claim 17 wherein the driven wheels are not able to cause longitudinal movement of the carriage on the pylon when the first sealing means is in sealing engagement with the pylon.

21. A pylon servicing means as claimed in claim 1 wherein the carriage is provided with a thruster means adapted to be capable of being activated to cause movement through water, said thruster applying a force to the carriage.

22. A pylon servicing means as claimed in claim 21 wherein the force is transverse to a central axis of the housing.

23. A pylon servicing means as claimed in claim 21 wherein the force is parallel to a central axis of the housing.

24. A pylon servicing means as claimed in claim 1 further including a plurality of ballast tanks associated with the carriage to vary the buoyancy of the carriage between positive, neutral and negative bouyancy.

25. A pylon servicing means as claimed in claim 1 wherein the housing has a generally cylindrical shape when the portions are in the closed position.

* * * * *